US008585407B2

(12) United States Patent
Hu

(10) Patent No.: US 8,585,407 B2
(45) Date of Patent: Nov. 19, 2013

(54) TOY GUN BACKLASH VIBRATION MECHANISM

(76) Inventor: Shih-Che Hu, Yung Kang (TW)

( * ) Notice: Subject to any disclaimer, the term of this patent is extended or adjusted under 35 U.S.C. 154(b) by 550 days.

(21) Appl. No.: 12/876,260

(22) Filed: Sep. 7, 2010

(65) Prior Publication Data

US 2011/0287388 A1 Nov. 24, 2011

(30) Foreign Application Priority Data

May 21, 2010 (TW) ..... 099209608 U

(51) Int. Cl.
*F41A 33/00* (2006.01)

(52) U.S. Cl.
USPC ..... 434/18; 124/7; 124/16

(58) Field of Classification Search
USPC ..... 434/18; 124/7, 16
See application file for complete search history.

(56) References Cited

U.S. PATENT DOCUMENTS 5,261,384 A * 11/1993 Hu ..... 124/66
5,467,549 A * 11/1995 Rowlands et al. ..... 42/42.03
8,056,276 B2 * 11/2011 Hu ..... 42/54
8,074,392 B2 * 12/2011 Hu ..... 42/54
8,091,542 B2 * 1/2012 Hu ..... 124/77
8,123,623 B2 * 2/2012 Kitami et al. ..... 463/51
8,146,576 B2 * 4/2012 Hu ..... 124/31
8,146,577 B2 * 4/2012 Hu ..... 124/32
8,156,930 B2 * 4/2012 Hu ..... 124/71
8,297,269 B2 * 10/2012 Hu ..... 124/67
2003/0098019 A1 * 5/2003 Hu ..... 124/66
2008/0155875 A1 * 7/2008 Iwasawa ..... 42/54
2009/0101130 A1 * 4/2009 Hu ..... 124/80
2009/0127758 A1 * 5/2009 Hu ..... 267/167
2010/0206633 A1 * 8/2010 Moore et al. ..... 175/4.56
2010/0229843 A1 * 9/2010 Hu ..... 124/80
2011/0041825 A1 * 2/2011 Hu ..... 124/71
2011/0146647 A1 * 6/2011 Hu ..... 124/76
2011/0174283 A1 * 7/2011 Hu ..... 124/31
2011/0192386 A1 * 8/2011 Hu ..... 124/32
2011/0192387 A1 * 8/2011 Hu ..... 124/80
2011/0275036 A1 * 11/2011 Rauser ..... 434/18
2011/0283984 A1 * 11/2011 Hu ..... 124/77
2011/0287388 A1 * 11/2011 Hu ..... 434/18
2011/0306020 A1 * 12/2011 Peterson ..... 434/18
2011/0318715 A1 * 12/2011 Markert et al. ..... 434/18
2012/0138038 A1 * 6/2012 Lee ..... 124/80
2012/0148989 A1 * 6/2012 Lvovskiy et al. ..... 434/18
2012/0240911 A1 * 9/2012 Hu ..... 124/41.1
2012/0240912 A1 * 9/2012 Hu ..... 124/80
2012/0272941 A1 * 11/2012 Hu ..... 124/83

* cited by examiner

*Primary Examiner* — Gene Kim
*Assistant Examiner* — Joseph B Baldori
(74) *Attorney, Agent, or Firm* — Raymond Y. Chan; David and Raymond Patent Firm

(57) ABSTRACT

A backlash vibration mechanism used in a toy gun and arranged above a piston-cylinder mechanism is disclosed, having a weight inserted through a disarm mechanism, a reaction spring adapted for returning the weight after the weight having been moved backwards and a brake unit arranged at the front side relative to the disarm mechanism and adapted for pushing the disarm mechanism backwards to simulate the action of the disarm mechanism of a real gun when producing a backlash vibration.

8 Claims, 14 Drawing Sheets

TOY GUN BACKLASH VIBRATION MECHANISM

BACKGROUND OF THE PRESENT INVENTION

1. Field of Invention

The present invention relates to a toy gun (air soft gun/BB-gun) and more particularly, to a toy gun backlash vibration mechanism that can move the disarm mechanism synchronously, assuring accurate position.

2. Description of Related Arts

To simulation of a real automatic gun, a toy gun (air soft gun/BB-gun) may be provided with a backlash vibration mechanism. FIG. 1 illustrates a conventional toy gun, which comprises a backlash vibration mechanism a', a piston-cylinder mechanism b', a gun shell c', a transmission mechanism d', a trigger e' and a bullet pusher f'. As illustrated, the piston-cylinder mechanism b' comprises a piston 10 and a piston spring 101. The backlash vibration mechanism a' comprises a weight 30 and a reaction spring 40. The backlash vibration mechanism a' is arranged at the rear side in axial alignment with the piston 10 of the piston-cylinder mechanism b'. When pressed the trigger e', the transmission mechanism d' is forced to move the piston-cylinder mechanism b', causing the bullet pusher f' to push the bullet into the firing position for striking by (the firing pin of) the piston 10. During movement of the transmission mechanism d', the piston 10 is moved backwards, forcing the weight 30 against the reaction spring 40. When over the compression limit of the reaction spring 40, the reaction spring 40 forces the weight 30 forwards, and the piston 10 is moved forwards in a rush to shoot the bullet. During forward movement of the weight 30, a reactive force is produced, causing a backlash vibration. This backlash vibration is produced each time the trigger e' is pressed. Similar backlash vibration designs are seen in Taiwan Patent Nos. M374045; I304469; I1317805.

However, different toy guns have different space designs. To a toy gun that has no extra space in the rear side of the gun shell c' for accommodating the backlash vibration mechanism a', the gun structure must be re-designed so that a backlash vibration can be produced each time the trigger is pressed. Taiwan Patent N0. I304469 teaches the installation of a backlash vibration mechanism a' in the space above the piston-cylinder mechanism b' (see FIG. 2).

Further, in order to simulate the operation of a real gun, the aforesaid prior art toy guns are commonly equipped with a disarm mechanism (not shown in FIGS. 1 and 2). The disarm mechanism is visible from the outside of the toy gun, i.e., the body of the toy gun has an opening through which the internal disarm mechanism can be seen. According to the prior art designs, the disarm mechanism is movable with the piston-cylinder mechanism b'. However, when fired (more particularly under a single shot operation), the piston-cylinder mechanism b' will still be moved for a distance by an inertial force after stoppage of the transmission mechanism d'. Therefore, the piston-cylinder mechanism b' may be not kept in the foremost end when stopped, causing the disarm mechanism to be stopped in an inaccurate position unlike the operation of a real gun. Therefore, an improvement in this regard is necessary.

SUMMARY OF THE PRESENT INVENTION

The present invention has been accomplished under the circumstances in view. It is the main object of the present invention to provide a toy gun (air soft gun/BB-gun) backlash vibration mechanism that enables the disarm mechanism to be synchronously moved with the backlash vibration mechanism, assuring accurate positioning.

To achieve this and other objects of the present invention, a backlash vibration mechanism is used in a toy gun having a forwardly returnable piston-cylinder mechanism and a disarm mechanism and arranged above said piston-cylinder mechanism. The backlash vibration mechanism comprises a weight inserted through the disarm mechanism and having a retaining portion, a reaction spring connected between the rear side of the weight and a part of the toy gun and adapted for returning the weight after the weight having been moved backwards, and a brake unit arranged at the front side relative to the disarm mechanism. The brake unit comprises a retaining member and a braking block. The retaining member is adapted for retaining the retaining portion of the weight for synchronous movement with the weight when the weight is moved forwards by the reaction spring upon each operation of the toy gun. The braking block is moved backwards to push the disarm mechanism backwards when the retaining member is moved forwards.

Further, the brake unit comprises an actuating member connected to the retaining member, and a gear pivotally mounted in the toy gun. The actuating member has a toothed portion meshed with the gear at one side. The braking block has a toothed portion meshed with the gear at an opposite side relative to the actuating member, and is movable by the gear in a reversed direction relative to the actuating member.

Further, the retaining member is normally kept in an upward position and adapted for retaining the retaining portion of the weight when the weight is moved backwards. The toy gun comprises a front shell located on the front side thereof adjacent to the weight and the retaining member. The front shell has a protruding portion. When the weight and the retaining member are moved to the front limit position, the retaining member is forced downwardly away from the retaining portion of the weight by the protruding portion.

The backlash vibration mechanism further comprises a spring member connected between the front shell and the actuating member, and adapted for returning the actuating member after the actuating member having been moved.

Further, the weight comprises a front notch located on the front side of the retaining portion and a rear notch located on the rear side of the retaining portion. The retaining member is movable between the front notch and the rear notch. The retaining member and the retaining portion of the weight are retained together for synchronous movement when the retaining member is engaged into the front notch. The weight is movable relative to the retaining member when the retaining member is positioned in the rear notch.

DETAILED DESCRIPTION OF THE PREFERRED EMBODIMENT

Figure 1:
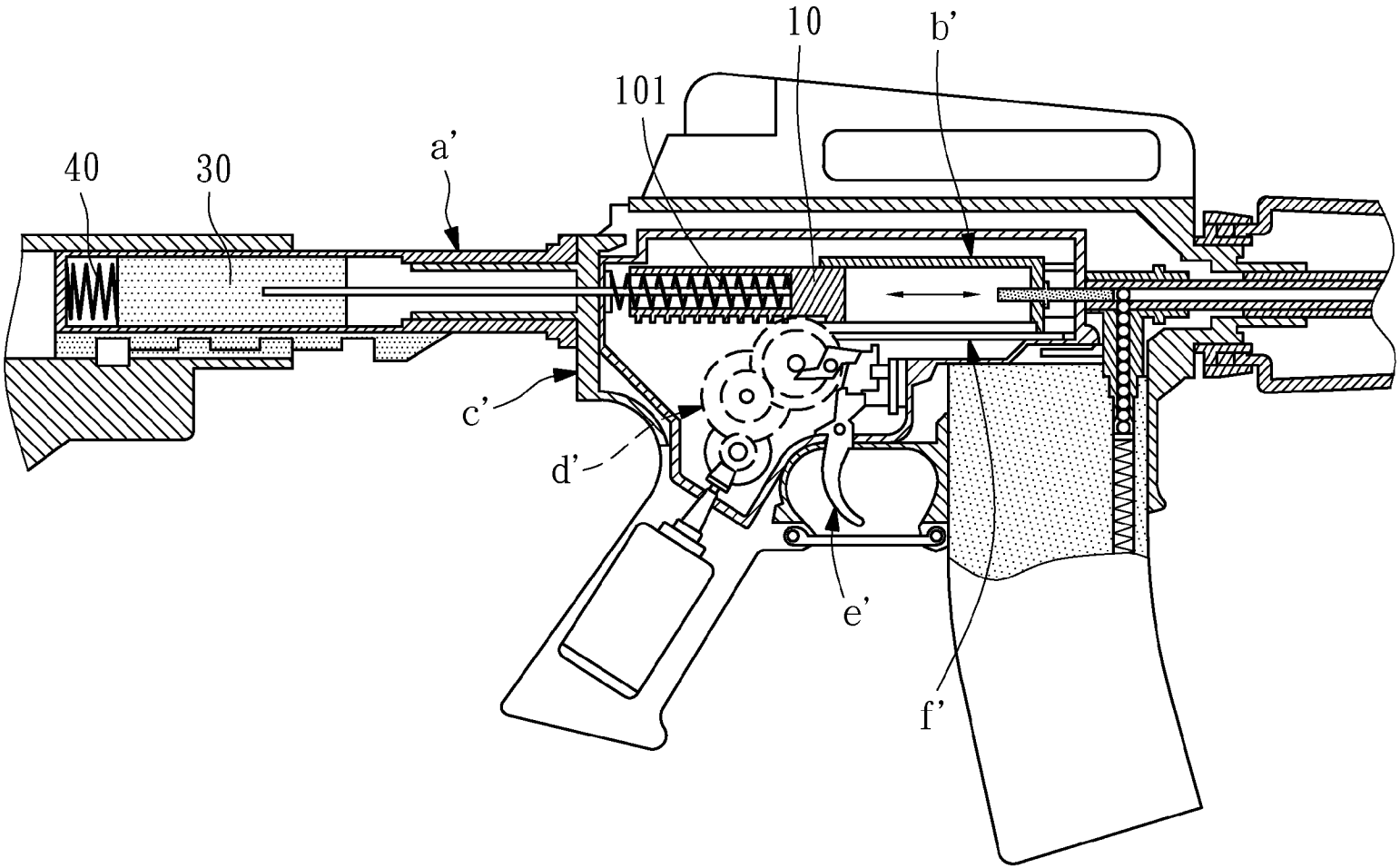
FIG. 1(PRIOR ART)
FIG. 1 is a schematic drawing of a part of a toy gun (air soft gun/BB-gun) according to the prior art, illustrating the arrangement of the backlash vibration mechanism and firing of a bullet.
Figure 2:
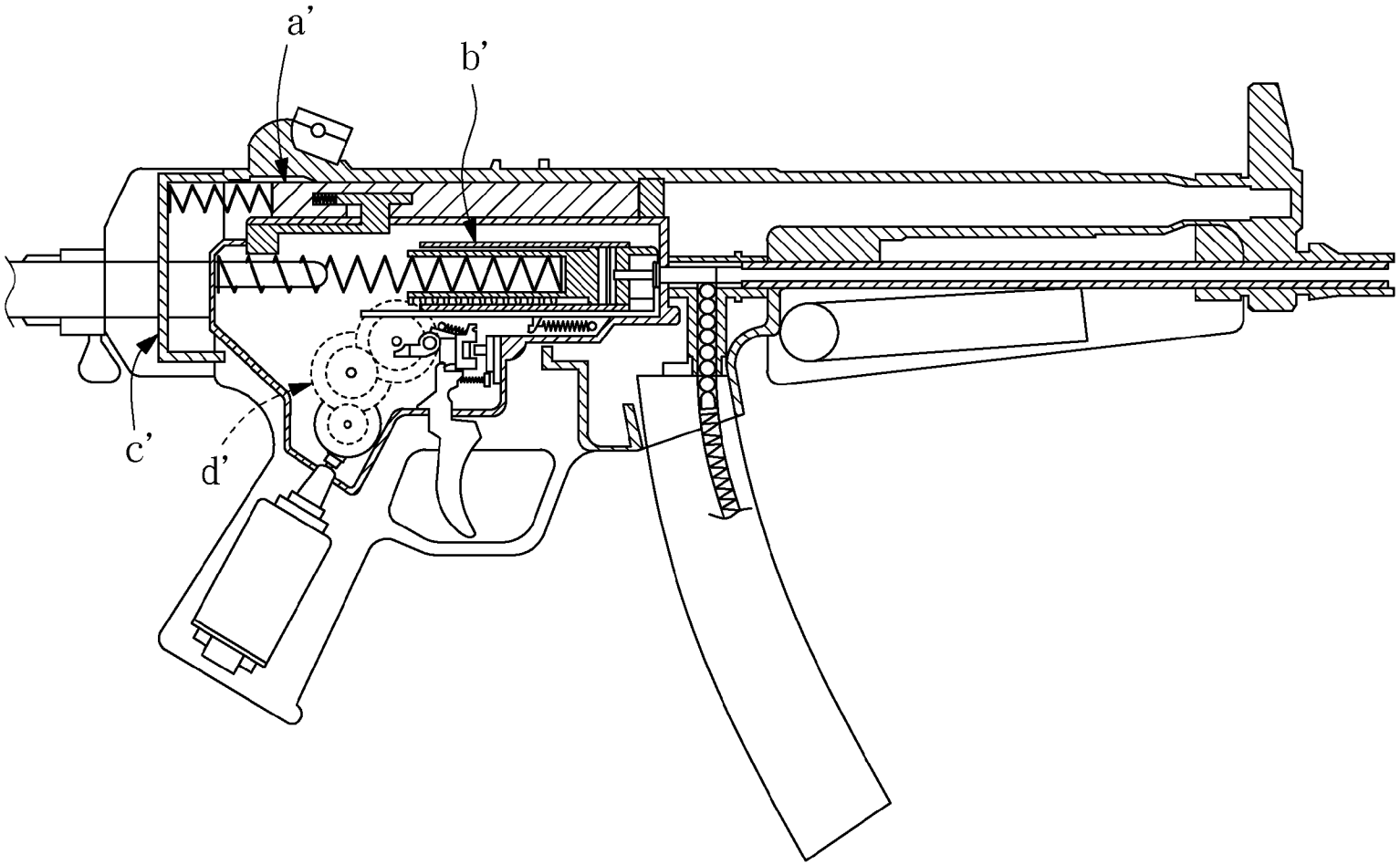
FIG. 2(PRIOR ART)
FIG. 2 is a schematic drawing illustrating the arrangement of a backlash vibration mechanism in another prior art design of toy gun.
Figure 3:
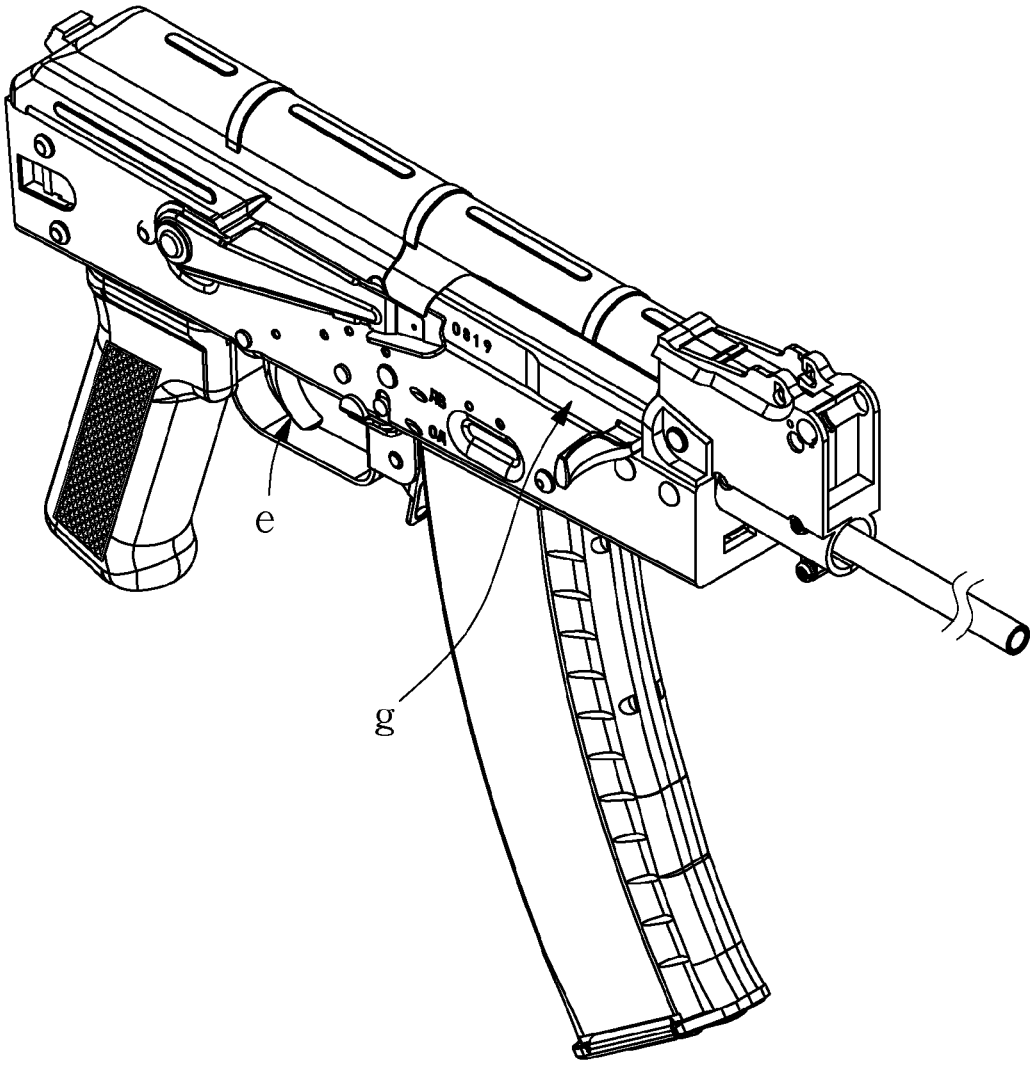
FIG. 3 is an elevational view of a toy gun (air soft gun/BB-gun) according to the present invention.
Figure 4:
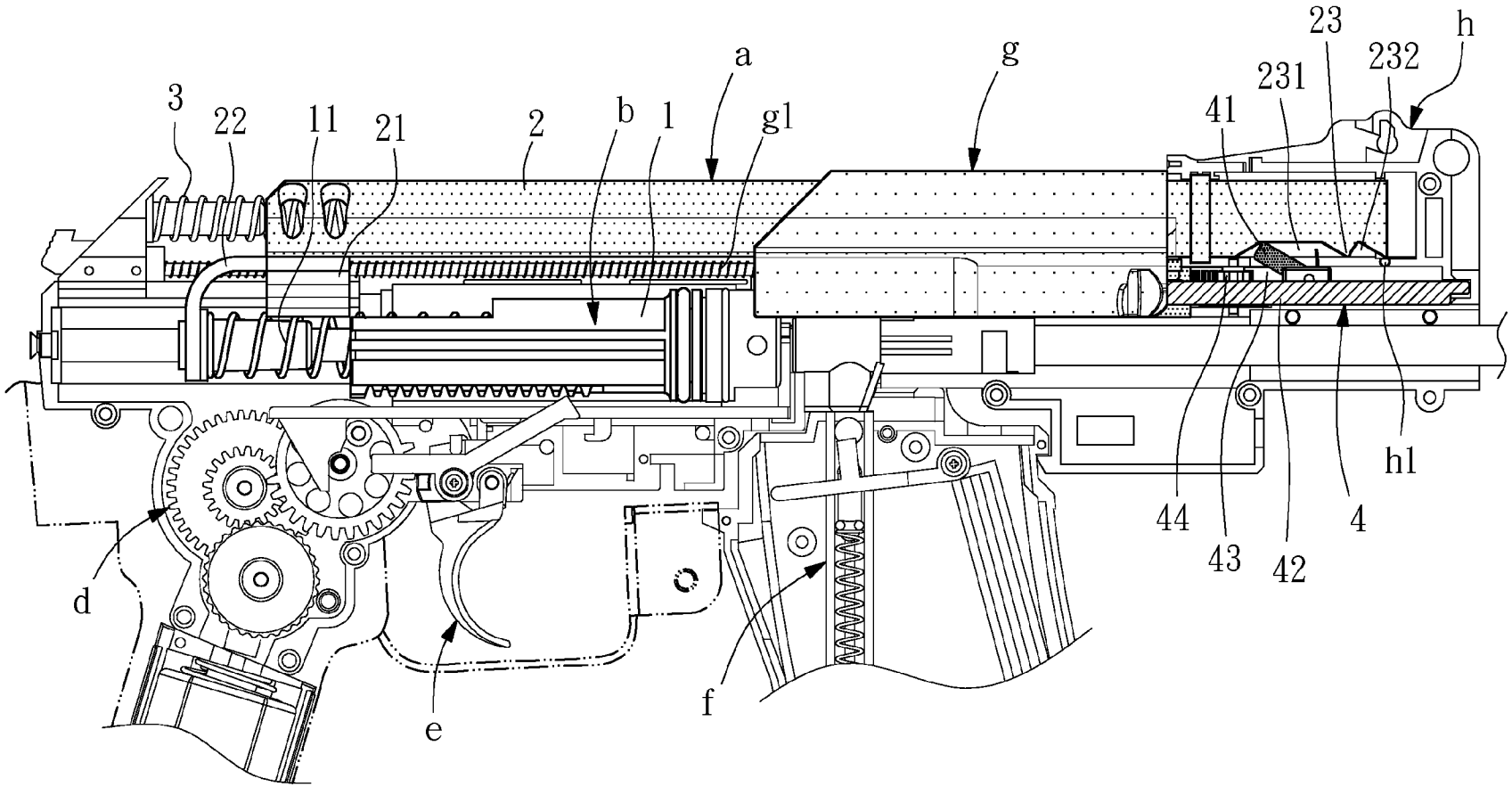
FIG. 4 is a schematic sectional side plain view of the toy gun (air soft gun/BB-gun) according to the present invention.

Referring to FIGS. 3 and 4, a backlash vibration mechanism a is arranged in a toy gun above a piston-cylinder mechanism b, which comprises a piston 1 and a piston spring 11 mounted in the rear side of the piston 1. The toy gun further comprises a transmission mechanism d, a trigger e and a bullet pusher f arranged below the piston-cylinder mechanism b. When pressed the trigger e, the transmission mechanism d is forced to move the piston-cylinder mechanism b, causing the bullet pusher f to push the bullet into the firing position for striking by (the firing pin of) the piston 1. The bullet firing operation of the toy gun is same as conventional designs. Therefore, no further detailed description in this regard is necessary. Further, the toy gun comprises a disarm mechanism g. The piston-cylinder mechanism b and the disarm mechanism g are elastically reversible. As shown in FIG. 4, when the piston 1 is released from the transmission mechanism d after each movement, the piston 1 will be moved forwards to its former position by the piston spring 11, and at the same time, the disarm mechanism g is moved forwards to its former position by a first spring g1.

Figure 5:
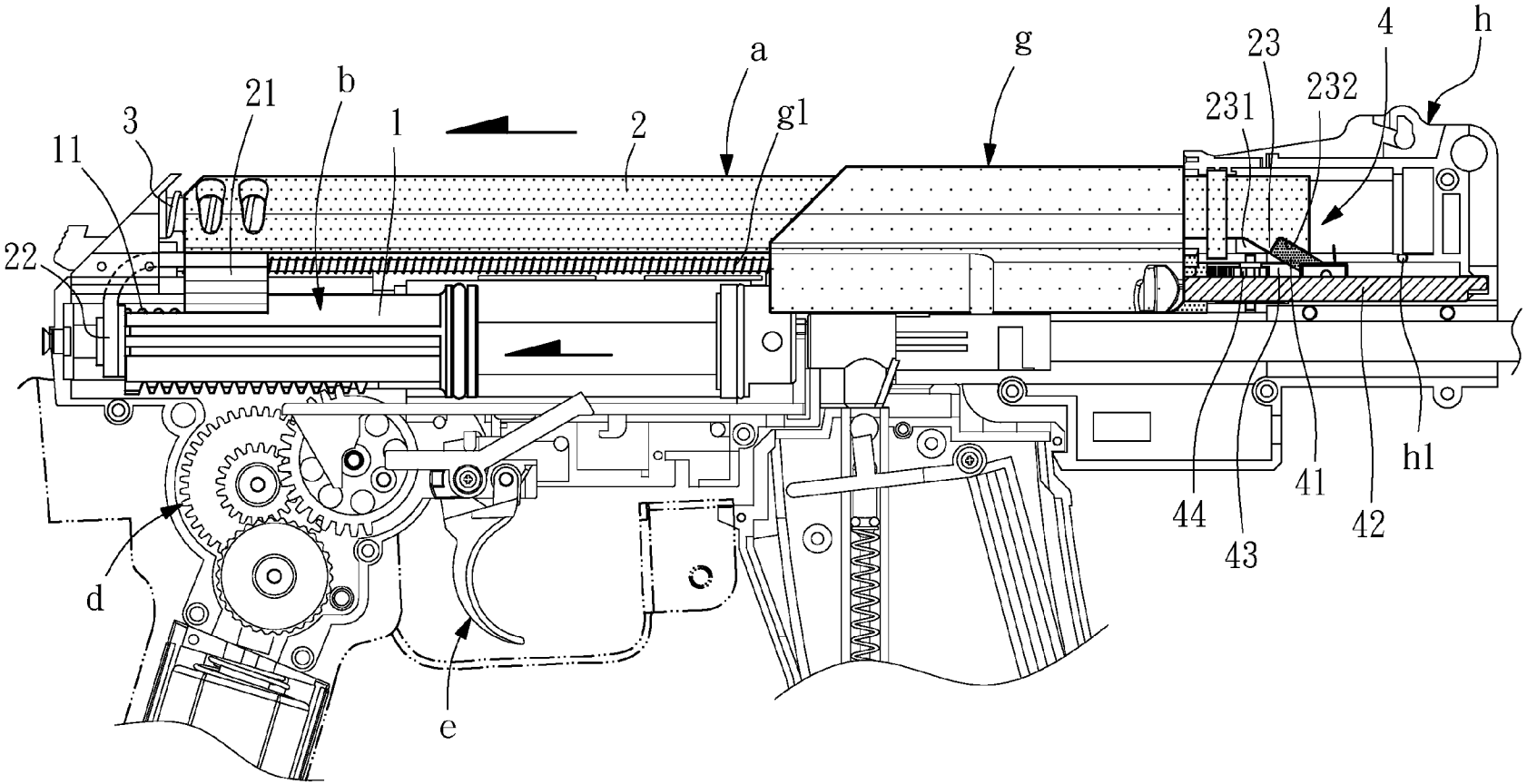
FIG. 5 is a schematic sectional side plain view of the present invention, illustrating the internal status of the toy gun upon a backward movement of the weight.
Figure 6:
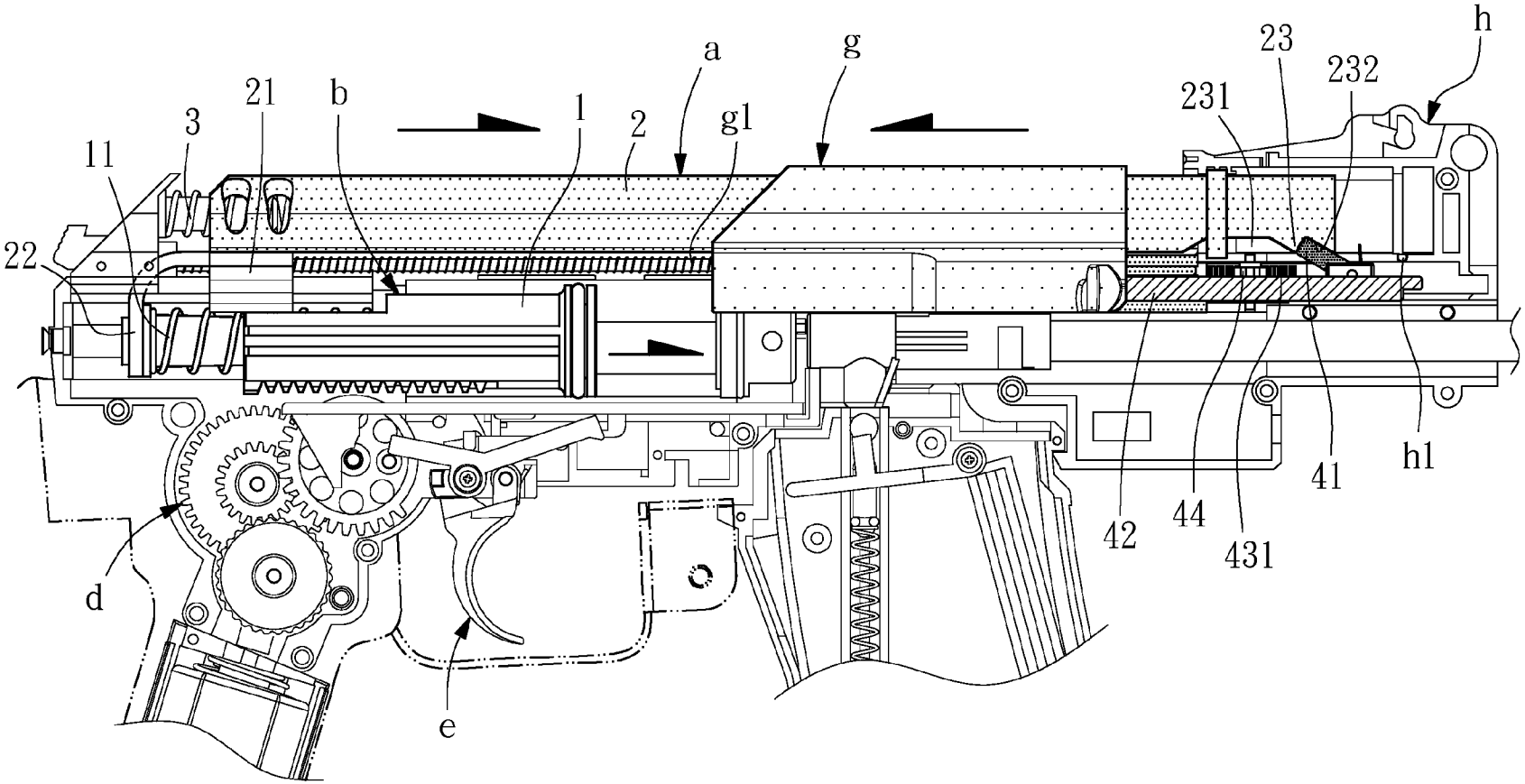
FIG. 6 is a schematic sectional side plain view of the present invention, illustrating the internal status of the toy gun upon a forward movement of the weight.

Further, the backlash vibration mechanism a comprises a weight 2 and a reaction spring 3 (see FIG. 4). The reaction spring 3 is located on the rear side of the weight 2. Further, the weight 2 has its rear side connected with a holder 21 and a block member 22. When the piston 1 is moved backwards by the transmission mechanism d, the piston spring 11 is compressed by the piston 1 to push he block member 22 backwards, causing the weight 2 to be moved backwards by the holder 21 and the block member 22 (see FIG. 5), and the reaction spring 3 is compressed to preserve energy. When the piston 1 is released from the transmission mechanism d and moved forwards after each backward movement, the weight 2 is immediately forced forwards by the reaction spring 3 (see FIG. 6). Further, the weight 2 is inserted through the disarm mechanism g, having a retaining portion 23, and a front notch 232 and a rear notch 231 respectively located on the front and rear sides relative to the retaining portion 23.

Figure 7:
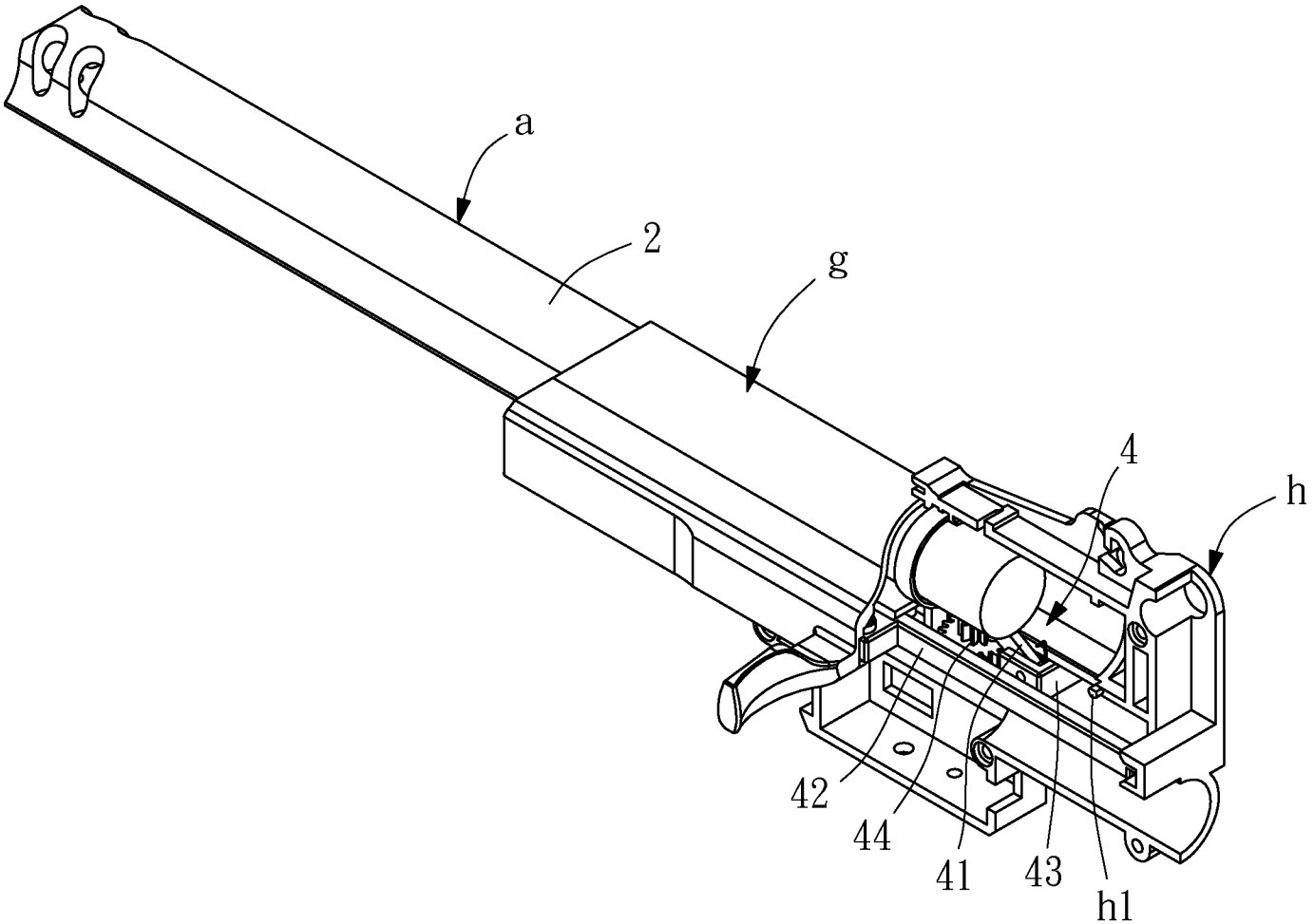
FIG. 7 is an elevational assembly view of the backlash vibration mechanism, the disarm mechanism, the brake unit and the front shell of the toy gun according to the present invention.
Figure 8:
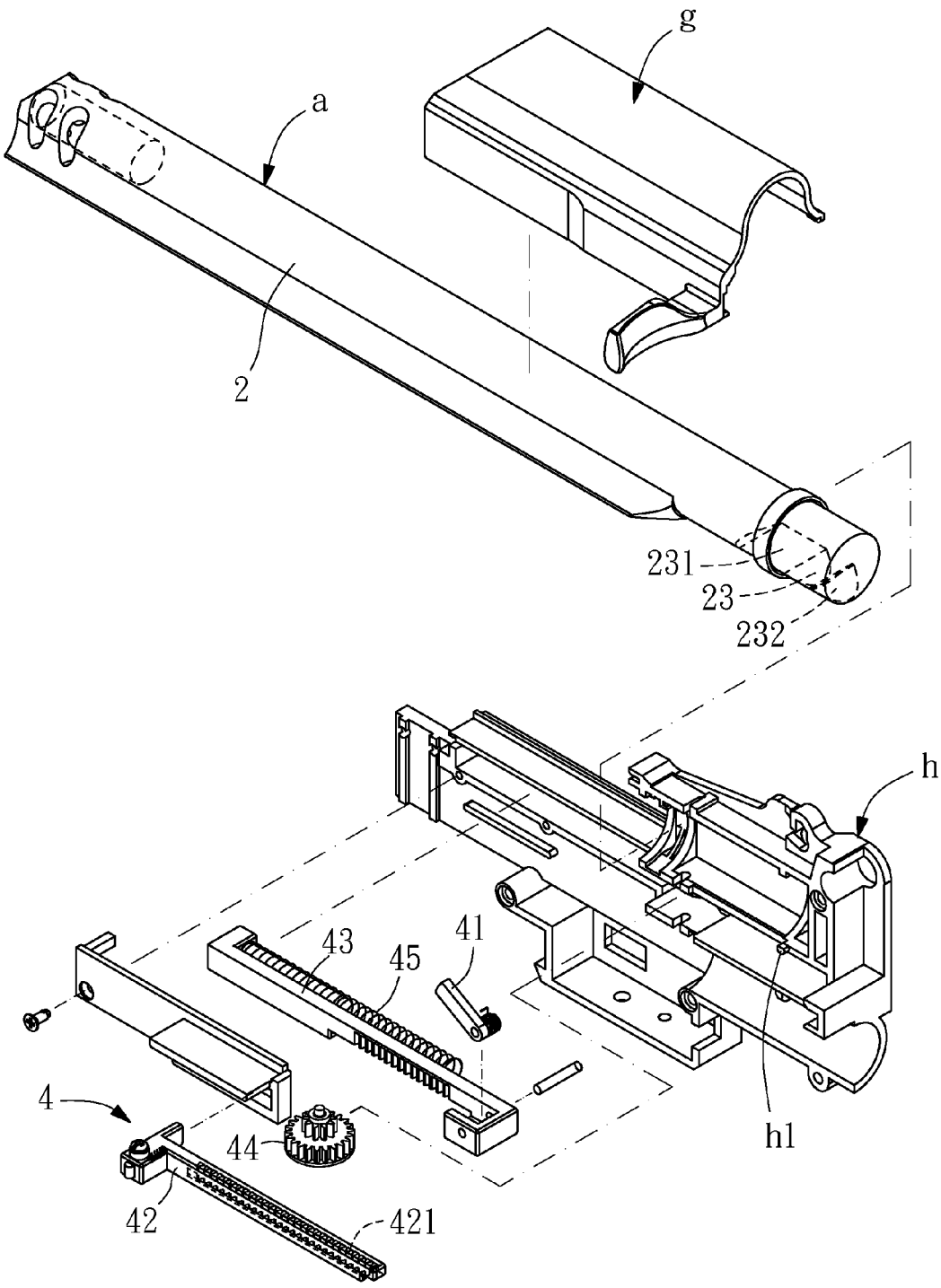
FIG. 8 is an exploded view of FIG. 7.
Figure 9:
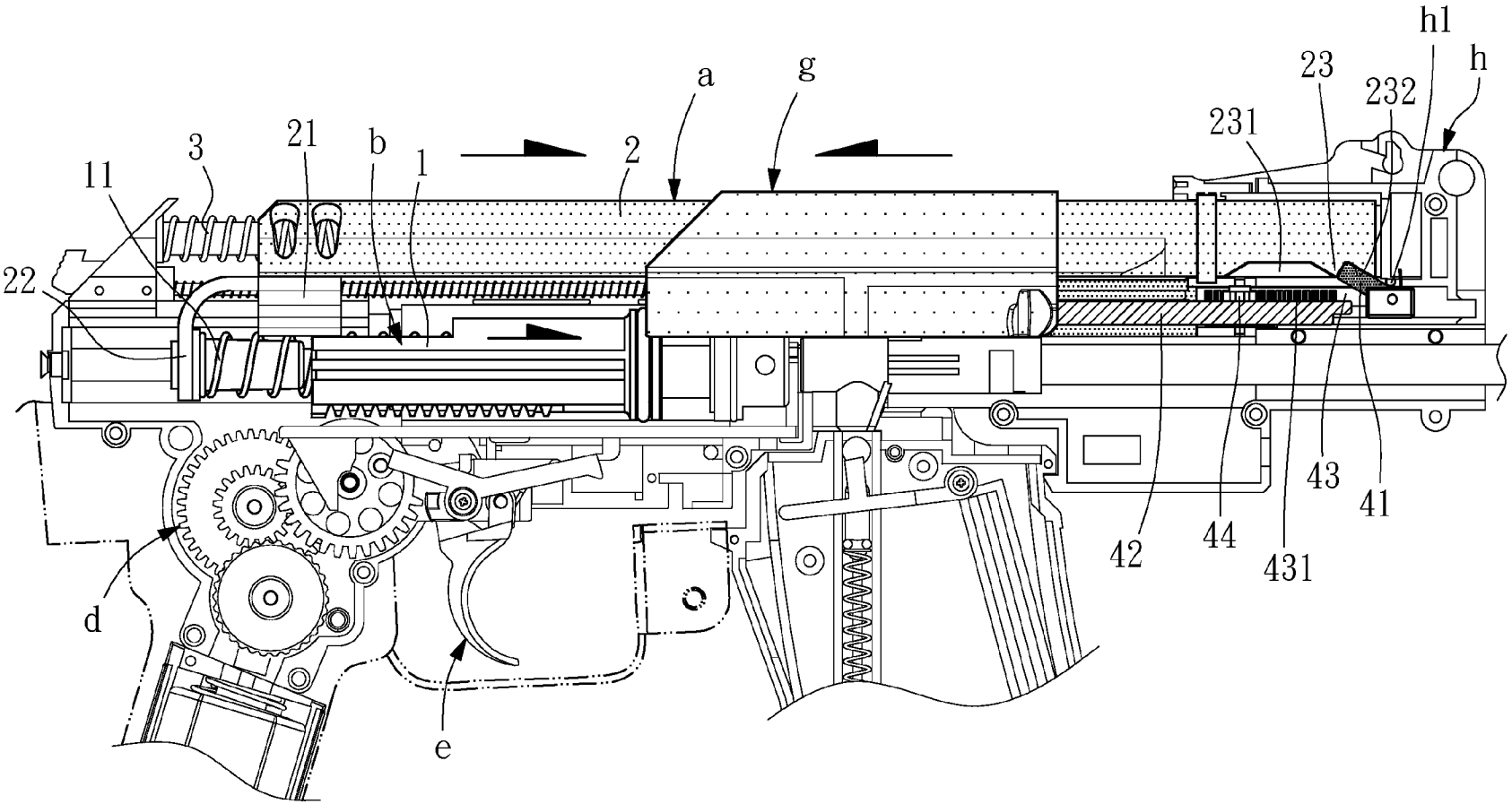
FIG. 9 corresponding to FIG. 6, illustrating the weight moved further forwards.
Figure 11:
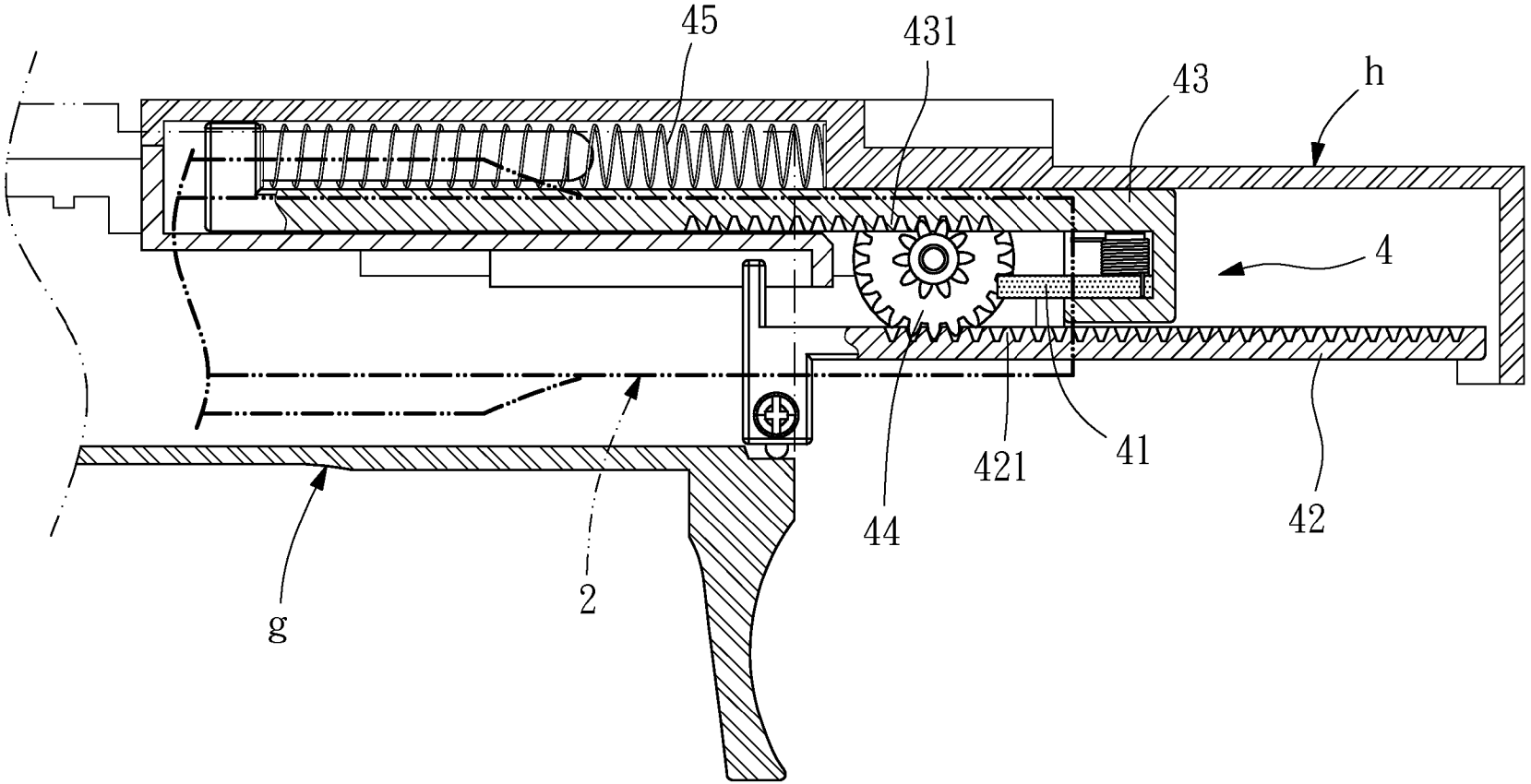
FIG. 11 is a schematic top view of a part of the present invention, illustrating the structure of the brake unit.
Figure 12:
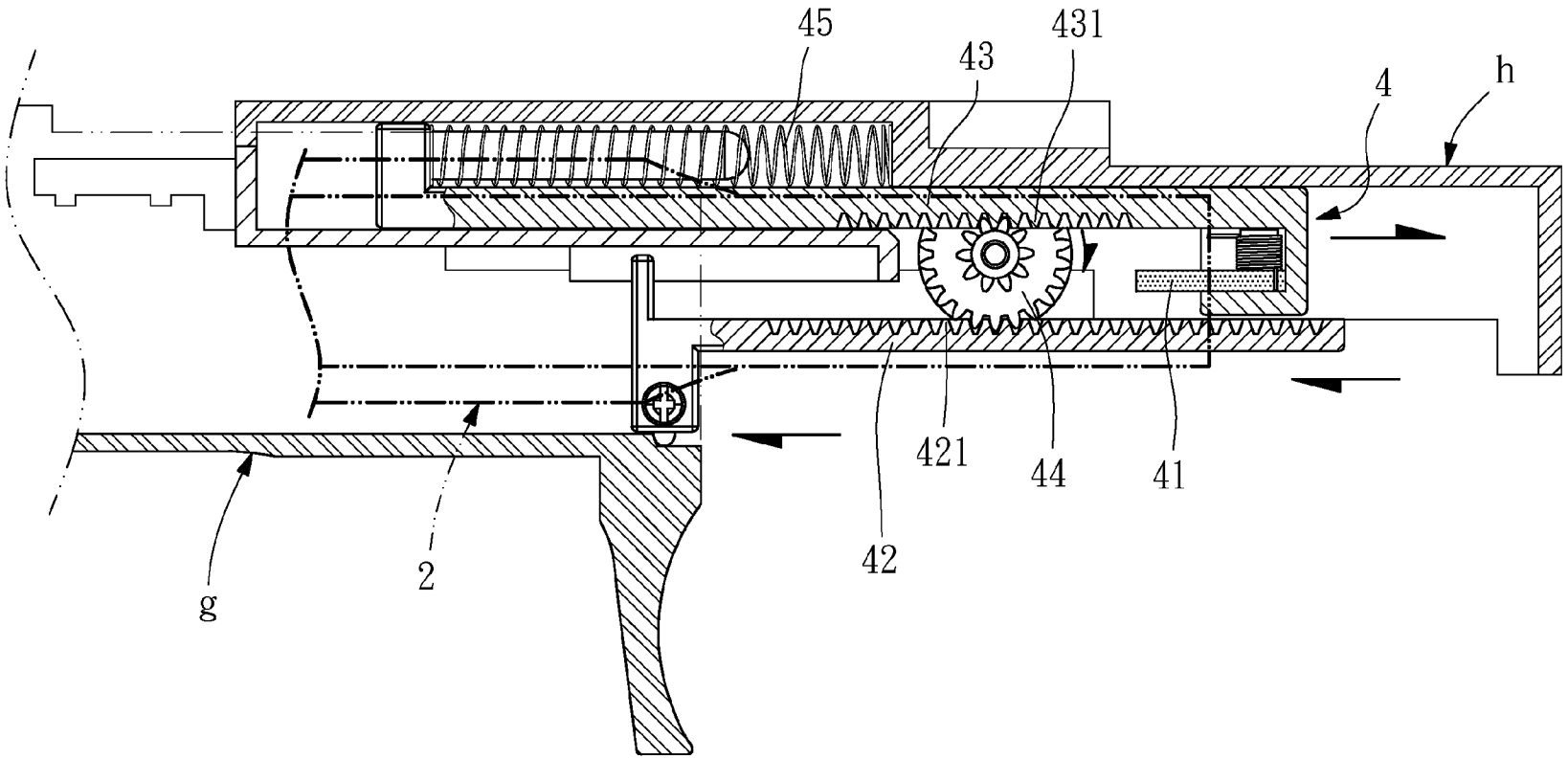
FIG. 12 corresponds to FIG. 11, illustrating the brake unit operated.

Further, a brake unit 4 is disposed at a front side relative to the disarm mechanism g (see FIGS. 4 and 7). The brake unit 4 comprises a retaining member 41, a braking block 42, an actuating member 43 and a gear 44 (see also FIG. 8). The retaining member 41 is normally kept in an upward position, and adapted for retaining the retaining portion 23 of the weight 2 when the weight 2 is moved backwards. When the weight 2 is moved backwards, the retaining member 41 is engaged into the front notch 232, thereby secured to the retaining member 41 of the brake unit 4 (see FIG. 5) for movement with the weight 2 forwardly (see FIGS. 6 and 9). Further, the retaining member 41 and the actuating member 43 are connected together. The actuating member 43 and the braking block 42 are respectively arranged at two opposite sides relative to the gear 44, each having a toothed portion 431;421 meshed with the gear 44 (see FIGS. 8 and 11). When the retaining member 41 is moved with the weight 2 forwardly, the actuating member 43 is followed, at this time, subject to the effect of the gear 44, the braking block 42 is moved in the reversed direction to push the disarm mechanism g backwards (see FIG. 12).

Figure 13:
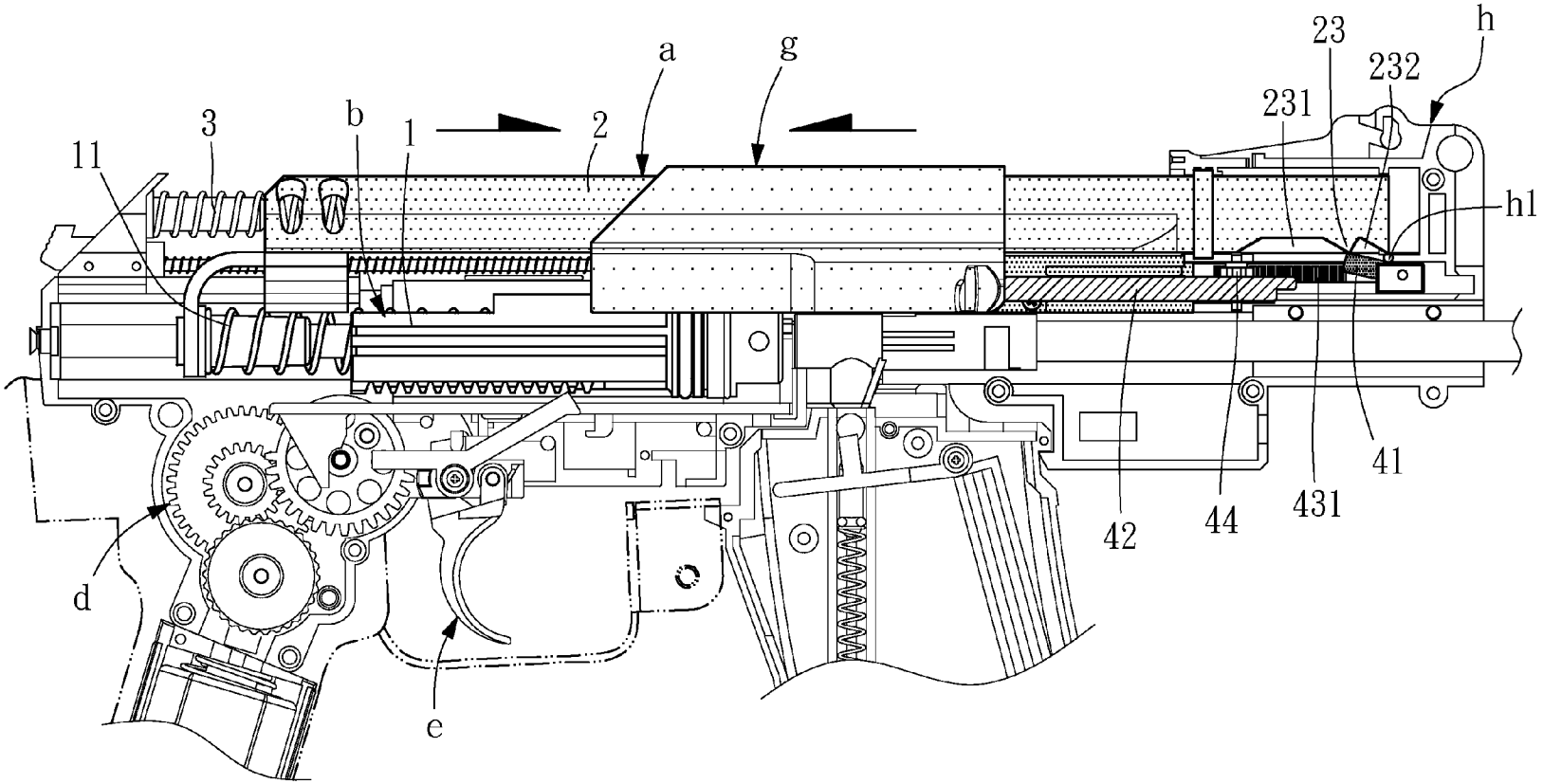
FIG. 13 is a schematic sectional side plain view of the present invention, illustrating the weight moved to the front limit position.
Figure 14:
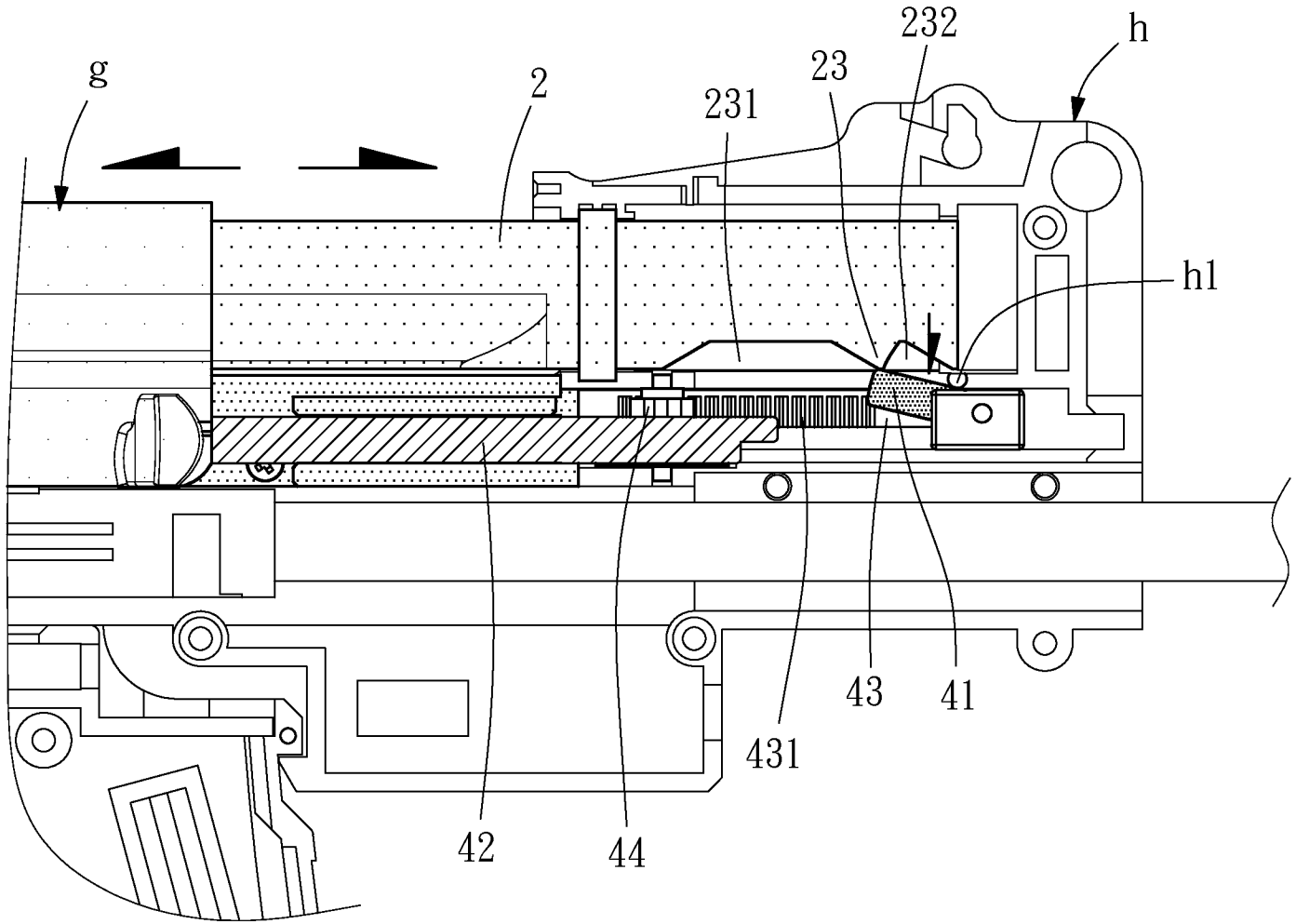
FIG. 14 is an enlarged view of a part of FIG. 13.

Further, the toy gun has a front shell h located on the front side adjacent to the weight 2 and the retaining member 41. The front shell h has a protruding portion h1 (see FIGS. 7 and 8). When the weight 2 and the retaining member 41 are moved to the front limit position, the retaining member 41 is forced downwardly away from the retaining portion 23 of the weight 2 by the protruding portion h1 (see FIGS. 13 and 14). Further, a spring member 45 is connected between the front shell h and the actuating member 43 for returning the actuating member 43 after each movement (see FIGS. 11 and 12). Therefore, when the weight 2 is moved to the front limit position and the retaining member 41 is forced downwardly away from the retaining portion 23 of the weight 2 by the protruding portion h1, the actuating member 43 is pulled backwards by the spring member 45. At this time, the braking block 42 is moved forwards, and the disarm mechanism g is moved forwardly to its former position (the position shown in FIG. 11) by the first spring g1 (see FIG. 4).

Figure 10:
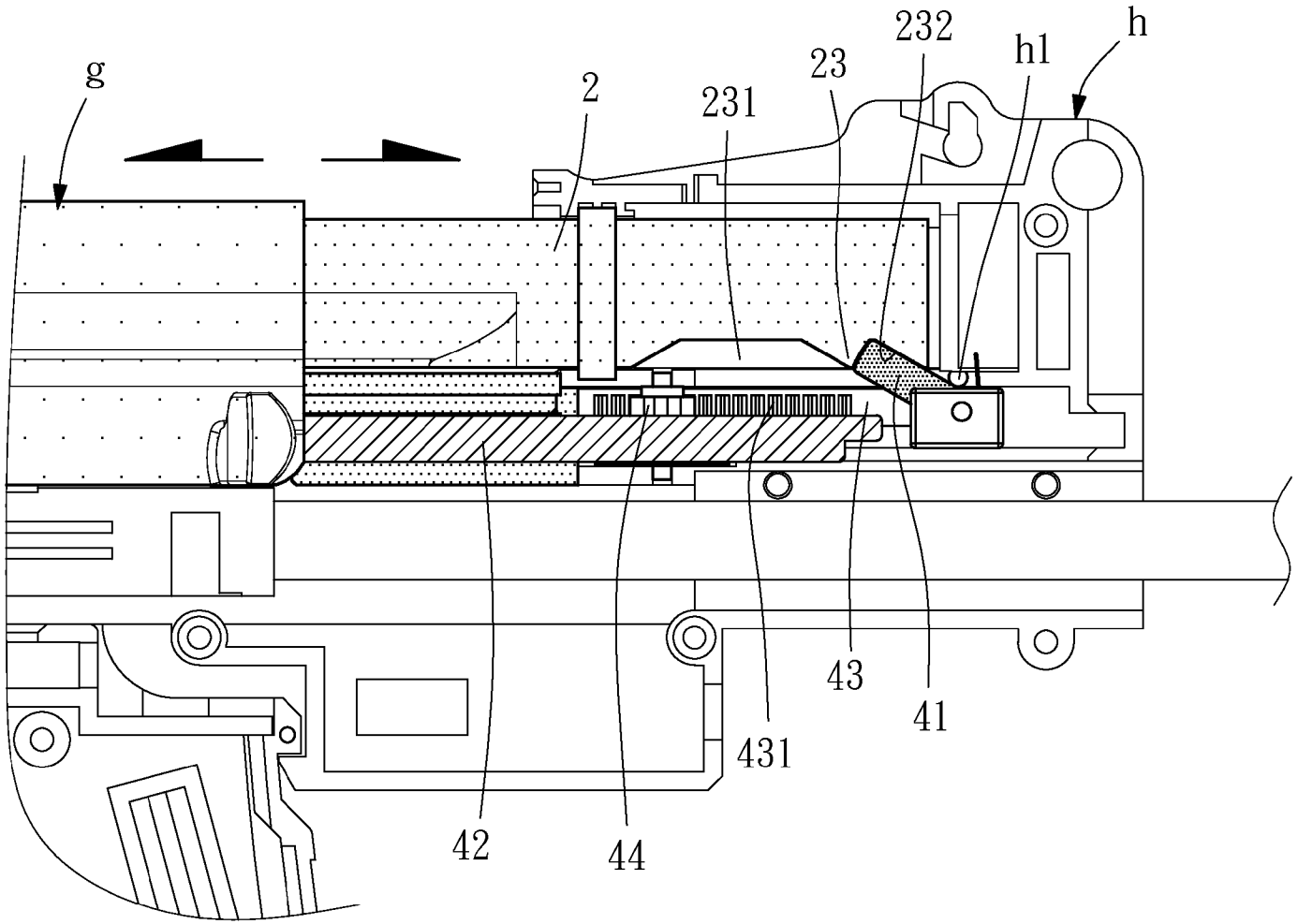
FIG. 10 is an enlarged view of a part of FIG. 9.

Thus, when the trigger e is not operated, the weight 2 is immovable, at this time the retaining member 41 is engaged in the rear notch 231 (see FIG. 4). When the trigger e is pressed to drive the transmission mechanism d, the piston 1 is moved backwards (see FIG. 5). At this time, the piston spring 11 is compressed, and the weight 2 is forced backwards by the piston spring 11, causing the holder 21 and the block member 22 to be moved backwards. At this time, the reaction spring 3 is compressed to preserve energy, the retaining member 41 is engaged into the front notch 232 and secured to the retaining portion 23 of the weight 2. When the piston 1 is moved backwards and then released by the transmission mechanism d (see FIG. 6), the piston 1 will strike against the bullet in the firing position, causing the bullet to be fired. After firing of one bullet, the weight 2 is pushed forwards by the reaction spring 3, and the retaining member 41 with the weight 2 are carried forwards (see FIGS. 6, 9 and 10), and therefore the actuating member 43 is carried forwards too (see FIG. 12). At the same time, the braking block 42 is moved by the gear 44 to push the disarm mechanism g backwards (see FIGS. 6, 9 and 12). When the weight 2 is moved forwards, a backlash vibration is simultaneously produced.

Thereafter, when the weight 2 and the retaining member 41 are moved to the front limit position, the retaining member 41 is forced downwardly away from the retaining portion 23 of the weight 2 by the protruding portion h1 (see FIGS. 13 and 14), and the weight 2 is released from the constraint of the retaining member 41 and forced by the reaction spring 3 forwardly to its former position shown in FIG. 4, and at the same time the actuating member 43 is pulled backwards by the spring member 45, causing the braking block 42 to be moved forwards (to the position shown in FIG. 11), and therefore the disarm mechanism g is returned to its former position by the first spring g1 to finish one operation cycle.

As stated above, the backlash vibration mechanism a is arranged in the toy gun above the piston-cylinder mechanism b, and can carry the disarm mechanism g synchronously to simulate the disarm operation of a real gun. Thus, the disarm mechanism g can be moved accurately, enhancing simulation credibility and product advantages.

Although a particular embodiment of the invention has been described in detail for purposes of illustration, various modifications and enhancements may be made without departing from the spirit and scope of the invention.

What is claimed is:

1. A backlash vibration mechanism used in a toy gun having a forwardly returnable piston-cylinder mechanism and a disarm mechanism and arranged above said piston-cylinder mechanism, wherein said backlash vibration mechanism comprises:

a weight inserted through said disarm mechanism, wherein said weight comprises a retaining portion;

a reaction spring connected between a rear side of said weight and a part of said toy gun and adapted for returning said weight after said weight having been moved backwards; and a brake unit arranged at a front side relative to said disarm mechanism, wherein said brake unit comprises a retaining member and a braking block, wherein said retaining member is adapted for retaining said retaining portion of said weight for synchronously movement with said weight when said weight is moved forwards by said reaction spring upon each operation of said toy gun, wherein said braking block is moved backwards to push said disarm mechanism backwards to simulate a disarm operation of a real gun when said retaining member is moved forwards, wherein said toy gun comprises a front shell located on a front side thereof adjacent to said weight and said retaining member, wherein said front shell comprises a protruding portion, wherein when said weight and said retaining member are moved to a front limit position, said retaining member is forced downwardly away from said retaining portion of said weight by said protruding portion, and said weight is released from the constrain of said retaining member and forced back by said reaction spring, and said braking block is moved forwards and said disarm mechanism is forced back to finish one operation cycle.

2. The backlash vibration mechanism, as recited in claim 1, further comprising a first spring adapted for returning said disarm mechanism when said braking block is moved forwards.

3. The backlash vibration mechanism, as recited in claim 1, wherein said brake unit further comprises an actuating member connected to said retaining member and a gear pivotally mounted in said toy gun, wherein said actuating member comprises a toothed portion meshed with said gear at one side, wherein said braking block comprises a toothed portion meshed with said gear at an opposite side relative to said actuating member and is movable by said gear in a reversed direction relative to said actuating member.

4. The backlash vibration mechanism, as recited in claim 2, wherein said brake unit further comprises an actuating member connected to said retaining member and a gear pivotally mounted in said toy gun, wherein said actuating member comprises a toothed portion meshed with said gear at one side, wherein said braking block comprises a toothed portion meshed with said gear at an opposite side relative to said actuating member and is movable by said gear in a reversed direction relative to said actuating member.

5. The backlash vibration mechanism, as recited in claim 3, further comprising a spring member connected between said front shell and said actuating member and adapted for returning said actuating member after said actuating member having been moved.

6. The backlash vibration mechanism, as recited in claim 1, wherein said weight further comprises a front notch located on a front side of said retaining portion and a rear notch located on a rear side of said retaining portion, wherein said retaining member is movable between said front notch and said rear notch, wherein said retaining member and said retaining portion of said weight are retained together for synchronous movement when said retaining member is engaged into said front notch, wherein said weight is movable relative to said retaining member when said retaining member is positioned in said rear notch.

7. The backlash vibration mechanism, as recited in claim 3, wherein said weight further comprises a front notch located on a front side of said retaining portion and a rear notch located on a rear side of said retaining portion, wherein said retaining member is movable between said front notch and said rear notch, wherein said retaining member and said retaining portion of said weight are retained together for synchronous movement when said retaining member is engaged into said front notch, wherein said weight is movable relative to said retaining member when said retaining member is positioned in said rear notch.

8. The backlash vibration mechanism, as recited in claim 5, wherein said weight further comprises a front notch located on a front side of said retaining portion and a rear notch located on a rear side of said retaining portion, wherein said retaining member is movable between said front notch and said rear notch, wherein said retaining member and said retaining portion of said weight are retained together for synchronous movement when said retaining member is engaged into said front notch, wherein said weight is movable relative to said retaining member when said retaining member is positioned in said rear notch.

* * * * *